US005704826A

United States Patent [19]

De Luis Vizcaino

[11] Patent Number: 5,704,826

[45] Date of Patent: Jan. 6, 1998

[54] MACHINE FOR GRINDING ROTOR BLADES PROVIDED WITH A MULTIWHEEL HEAD

[75] Inventor: Elias De Luis Vizcaino, Eibar, Spain

[73] Assignee: DANOBAT, S. Coop. Ltda., Elgoibar, Spain

[21] Appl. No.: 752,680

[22] Filed: Nov. 19, 1996

Related U.S. Application Data

[63] Continuation-in-part of Ser. No. 544,959, Oct. 18, 1995, abandoned.

[51] Int. Cl.[6] ..... B24B 5/00

[52] U.S. Cl. ..... 451/242; 451/246; 451/65; 451/362; 451/5; 451/6

[58] Field of Search ..... 451/65, 72, 194, 451/246, 195, 362, 363, 58, 66, 57, 5, 6

[56] References Cited

U.S. PATENT DOCUMENTS

| | | | |
|---|---|---|---|
| 2,458,840 | 1/1949 | Eklund | 451/65 |
| 4,461,121 | 7/1984 | Motzer et al. | 451/65 |
| 4,501,095 | 2/1985 | Drinkuth et al. | 451/246 |
| 4,615,150 | 10/1986 | Panetti | 451/362 |
| 5,618,222 | 4/1997 | Baima et al. | 451/65 |

FOREIGN PATENT DOCUMENTS

| | | | |
|---|---|---|---|
| 1502515 | 2/1969 | Germany | 451/65 |

*Primary Examiner*—Robert A. Rose
*Assistant Examiner*—George Nguyen
*Attorney, Agent, or Firm*—The Kline Law Firm

[57] ABSTRACT

A machine for grinding the rotor blades (4) of an aeronautical engine is equipped with a CNC control and its header (1) is a rotatable header provided with at least two grinders (2) of different abrasive materials, wherein each of them is coupled to the header (1) for being selected and then positioned in contact with the different stage blades (4) with the cooperation of the CNC. The machine for grinding also includes a measuring unit (10) fixed to the machine bed for controlling the radius of the blade stage, slides (11, 13) to displace the header (1) in two directions (X, W), and equipment to rotate the header (1) an angle (C) about its central transverse axis (1*a*). The CNC has registered the values of the grinder diameters (D1, D2) and the fixed position data (R1, A, R2, B) of the respective grinder profile (14, 15) relative to the central axis (1*a*).

2 Claims, 2 Drawing Sheets

MACHINE FOR GRINDING ROTOR BLADES PROVIDED WITH A MULTIWHEEL HEAD

This application is a continuation-in-part of my U.S. application Ser. No. 08/544,959, filed Oct. 18, 1995, abandoned, herein incorporated by reference in its entirety.

FIELD OF THE INVENTION

The current invention is related to a machine for high speed rectifying of the rotor blades of a motor for aeronautical or similar reactions and more specifically to its rotatable header of various grinders.

The compressor and turbine rotors of the reaction engines are parts of very high cost and are supplied by great number of blades, which are distributed axially in variable progressive stages and possess a strict profile which directly influences the efficiency and sonority of the engine.

BACKGROUND OF THE INVENTION

The modern turboreactor rotors have their blades jointly floating, in such a way that when the rotor is stopped these blades are lowered on the nucleus of the rotor and only when high rotation speeds are reached (2500 or 3000 r.p.m.), the centrifugal force causes the blades to rise until they reach their operative position.

Therefore, if the maximum degree of precision in the shaping of the blades is to be obtained, the rectifying will have to be done when the rotor is turning at actual high speed the blades stay positioned in front of the grinder at their exact operative position, and a measuring unit fixed to the bed of the machine controls the resulting radius of the blades' edges while they are being ground.

The degree of precision thus obtained allows a better adjustment in space dimension of space between the active edges of the rotor blades and the internal wall of the stator.

Until recently blades normally were of titanium, whose rectification was done by aluminum oxide grinders.

Nevertheless, blades currently are being built with a superficial aluminum oxide finish, therefore, they cannot be rectified by grinders of the same material. They require the use of diamond grinders which at the same time, are not suitable for rectifying titanium blades.

This produces an important problem not caused by the use of conventional grinders. The known rectifying machines for rotor blades provide headers equipped with only one grinder, which forces a change of grinder depending on the blade material to be rectified.

This not only occurs when changing the rotor, but also within the same rotor in which stages of blades different from one another may co-exist.

The measuring unit fixed to the bed of the known rectifying machines is always in alignment with the blades' edges for controlling the blade radius reduction. During machining, the blade edges are shaped according to an angle relative to the rotor shaft, and in order for the grinder to find the same tilting angle, the header of the known rectifying machine is tilted by turning it about an axis passing through the grinder profile, the latter remaining aligned with respect to the measuring unit. This means that the grinder profile keeps the same position relative to the measuring unite, and only the rotor is displaced towards the grinder for machining the following blade's stage. But in the case that another blade material should need to be machined, the only grinder must be disassembled, and as a result of the grinder replacement said position reference is lost.

Aside from the loss of time for the replacement of the grinder and change in work guidelines, the most negative aspect is a loss of precision caused by successive assembly and disassembly, counting on a precision factor of 5 microns. In any case, it is evident that working with this degree of precision one must try to avoid incurring risk situations such as a change of grinder. It would be absurd and irrational to reach such high precision of work only to lose it all in such manner.

The problem is important because of the technological tendency towards new materials of blades, which may necessitate the use of different grinders different from the previously mentioned of aluminum oxide and diamond.

SUMMARY OF THE INVENTION

The object of the invention is to provide a rectifying machine for rectifying, burring, and measuring the active profile of the blades of a turboreactor and the like. The machine is fitted with numeric control (CNC) for up to ten axes. The machine comprises a numeric control (CNC), a drive unit capable of turning the rotor more than 4000 r.p.m. installed together with the rotor on a moveable stand with a table which in turn slides over a bed. Affixed to the bed are a measuring unit, a multiwheel header provided with means for displacing the header, means for revolving the header, and means for rotating the grinding wheels.

The rectifying machine according to the present invention has the particularity that said rectifying header is a multiwheel header. The header is provided with at least two grinders of different material and abrasive coatings. The grinders are designed to rectify rotor blades or the like, and are made of different alloys. The machine has means for automatically selecting the grinders according to the rectifying parameters of each blade's stage, and means for operating and positioning the selected grinder in contact with the blade edges to be machined and in alignment with the measuring unit, and then machining the successive blades≡ stages with the rotor rotating at high speed.

This characteristic of the header, being provided with more than one grinder for selective use, constitutes a complete solution to the problem of machining a rotor with different blades without replacing the grinder during the job. The problem is solved by means of turning the multiwheel header until the selected grinder for machining is in an exactly proper position, thereby eliminating the need to assemble and disassemble the different grinders.

With this solution, the precision with which the machine was adjusted is not affected, and the time and labor necessary to replace the grinder by successively assembling and disassembling is saved.

The invention works with up to four grinders mounted on the same header, so that future, more demanding needs can be met.

BEST MODE OF CARRYING OUT THE INVENTION

Figure 2:
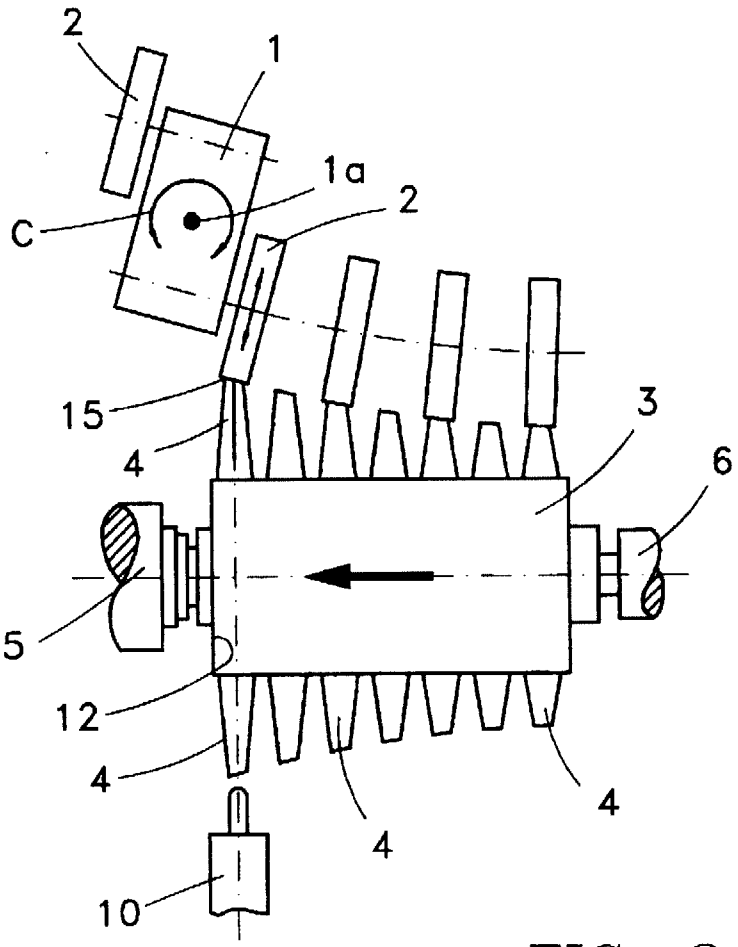
FIG. 2 is a partial side view of the machine with a rotor mounted therein.
Figure 1:
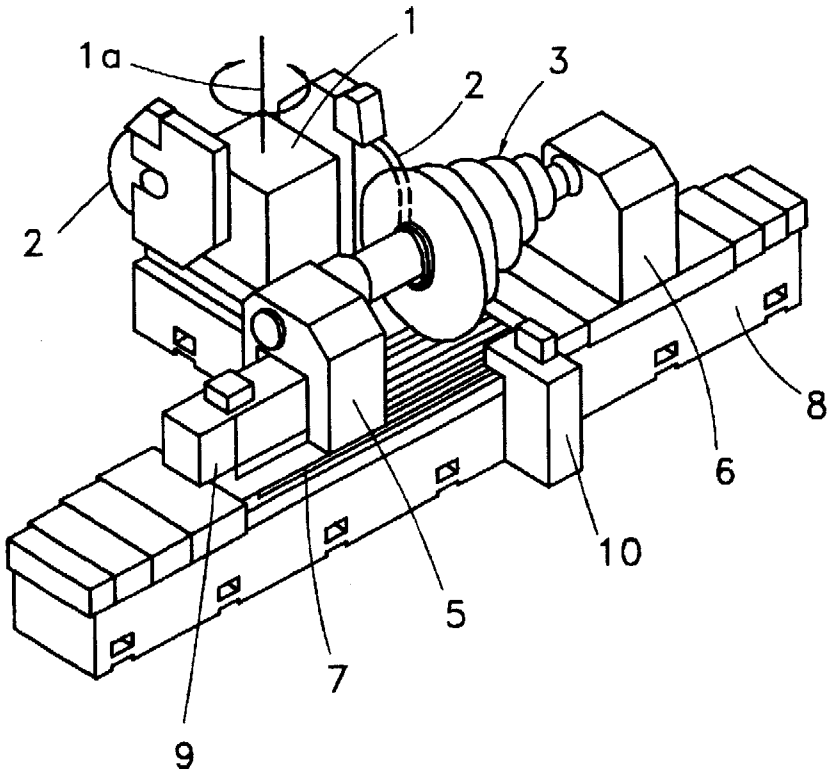
FIG. 1 is a perspective view which shows a rectifier according to the present invention with the header being provided with two grinders.
Figure 3:
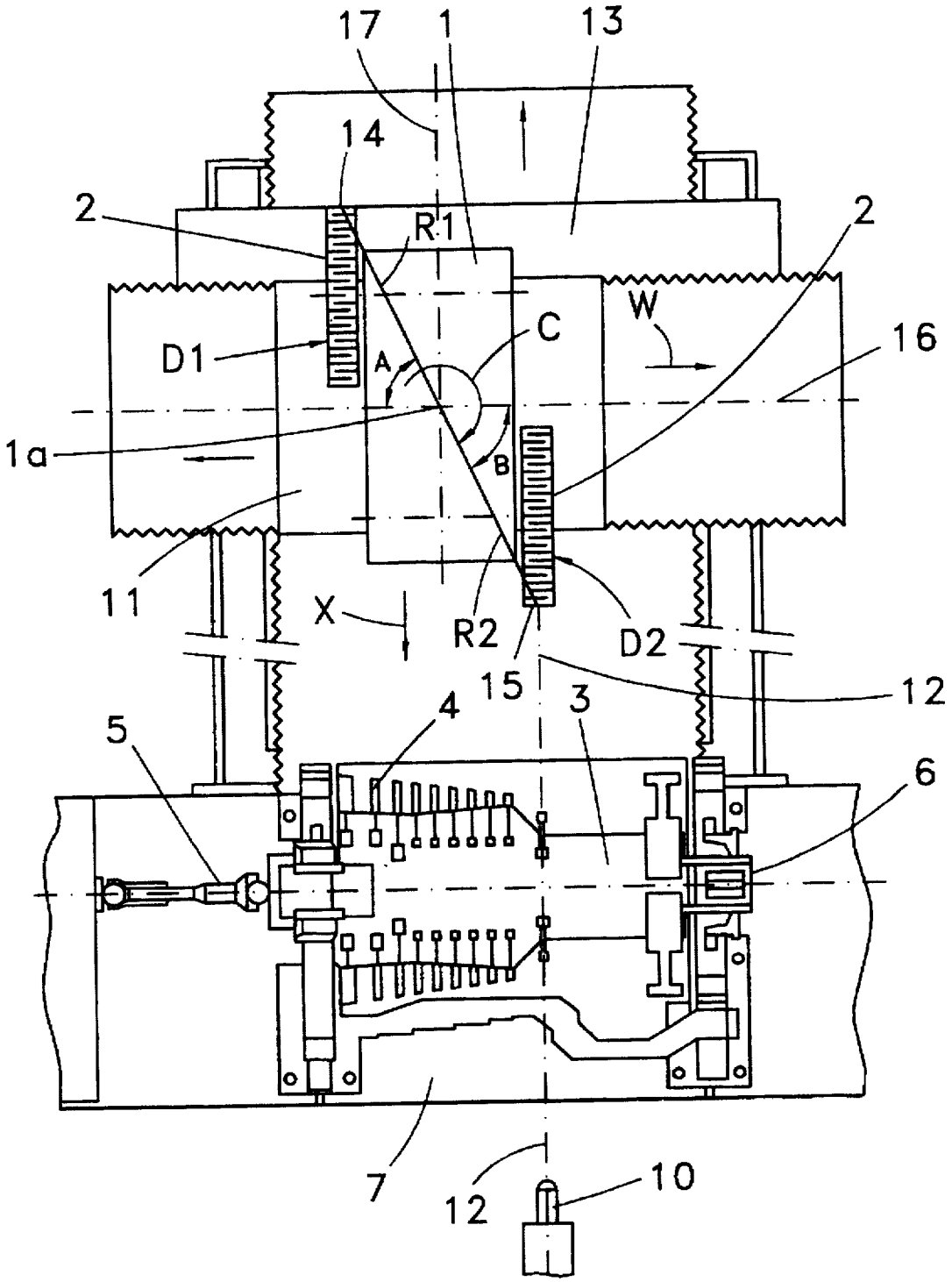
FIG. 3 is a side view of the machine which schematically shows the disposition of the rotor in relation to the multiwheel header and the measuring unit.

In reference to FIGS. 1 through 3, the present invention is a rectifying machine for rectifying, burring, and measuring the active profile of the rotor blades of a compressor or turbine of a turboreactor engine as shown in FIG. 2.

The machine comprises of a bed 8 over which slides a table 7, which in turn, supports a side stand point 5 and stand counterpoint 6 which between them operatively support the rotor 3. The rotor 3, through the operation unit 9 installed on its table 7, will be driven to rotate up to 3000 r.p.m., the speed at which each of the blades 4 will have taken a raised position relative to its normal, at rest position. The selected grinder 2 will be positioned to operate on the rotor 3 by advancing axially stage by stage. The position of the grinder 2 is shown as a discontinuous line in FIG. 2. The grinder 2 is aligned with the measuring unit 10, which is fixed to the bed 8.

FIGS. 1 through 3 show the essential characteristics of the invention. This rectifier has a multiwheel header 1, supplied with various grinders 2 which may be actuated in a selective manner by turning the header 1 through an angle C around its central transverse axis 1*a*. The grinders 2 are of different composition, aluminum oxide or diamond, so as to be able to work competently over blades 4 of different alloys, such as titanium and aluminum oxide.

The turned angle C in the header embodiment illustrated in FIG. 3 is the sum of 180° and the desired angle of tilting relative to the axis 17 which is perpendicular to the rotor shaft 5–6.

The measuring unit 10 faces the contact surface between the blade edges 4 to be ground and the grinder profile, according to the radial alignment 12 as shown in FIG. 3. The header axis 1*a* may be offset from the radial alignment 12 according to the desired angle of contact. As a result of the axis 1*a* offset, when the header 1 is turned through angle C about the axis 1*a*, in order for a second selected grinder 2 to be positioned for machining the following blade's stage, the grinder profile 15 of the selected grinder 2 must meet the alignment axis 12 facing the measuring unit 10. To achieve the exact proper position relative to the alignment axis 12, the header 1 is provided with two slides 11 and 13 to displace the header 1 parallel to and transverse to the rotor shaft 5–6. By means of the slides 11 and 13, the header 1 is displaced the distances X and W, which are calculated by the numeric control CNC using the previously registered data, D1 of the prior grinder diameter, D2 of the second grinder diameter, R1 and R2 the distances from the turning axis 1*a* to both grinder profiles 14 and 15, A and B the respective angles between these latter distances R1 and R2 lines and the axis 16 passing through the header center 1*a* parallel to the rotor shaft 5–6.

The embodiment of the header 1 with two grinders 2 is sufficient to cover current needs. However, it is envisioned that a header with three and possibly four grinders will be required to meet future needs.

I claim:

1. A machine for grinding rotor blades of an aeronautical or similar reaction engine comprising:

a numeric control CNC to control the movement of a rotor and the movement of a grinding header, a machine bed with a sliding table mounted thereon, said sliding table supports two opposing side stand supports for said rotor, said sliding table further supports a high speed rotating rotor operation unit, said machine bed further includes a measuring unit affixed to said machine bed to control a radius of a blades stage being rectified by a grinder coupled to said header, said measuring unit is aligned with said blades stage, and means for displacing said header in two at least two directions, and means for rotating said header about a central axis of said header, said means for displacing and said means for rotating said header are controlled by said CNC; wherein said grinding header is a rotatable header that comprises at least two grinders, a first abrasive coating of a first one of said grinders is formed from a material different than that of a second abrasive coating of a second one of said grinders, such that said first grinder has grinding characteristics differing from grinding characteristics of said second grinder, and wherein said grinders are coupled to said rotatable header so that when said header is rotated, said header positions a selected grinder on a blade stage according to header positioning data values, said header positioning data values are calculated by said CNC using geometrical data values of said grinders.

2. The machine for grinding rotor blades as claimed in claim 1 wherein:

said CNC stores diameters of said grinders and further stores fixed position data of profiles of said grinders relative to said central transverse axis, said CNC calculates said header positioning data values by comparing current position data values of a selected grinder with prior position data values of said selected grinder, said CNC causes said means for displacing and said means for rotating said header to position said selected grinder according to said calculated header positioning data values so as to perform a grinding operation on a corresponding blades stage.

* * * * *